US007192254B2

(12) United States Patent
Li et al.

(10) Patent No.: US 7,192,254 B2
(45) Date of Patent: Mar. 20, 2007

(54) RADIAL FAN HAVING AXIAL FAN BLADE CONFIGURATION

(75) Inventors: Nien-Lun Li, Hsin-Chuang (TW); Chih-Wen Tang, Hsin-Chuang (TW); Yun-Yeu Yeh, Hsin-Chuang (TW); Fu-Yin Wang, Hsin-Chuang (TW)

(73) Assignee: Datech Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 10/915,542

(22) Filed: Aug. 11, 2004

(65) Prior Publication Data

US 2006/0034694 A1 Feb. 16, 2006

(51) Int. Cl.
*F04D 29/30* (2006.01)

(52) U.S. Cl. ..... 416/175; 415/199.1; 416/178

(58) Field of Classification Search ..... 416/175, 416/203, 178; 415/199.1, 199.4, 199.6
See application file for complete search history.

(56) References Cited

U.S. PATENT DOCUMENTS 902,533 A * 10/1908 Hubbard ..... 415/199.6
2,258,459 A * 10/1941 Marbach ..... 416/175
3,201,032 A * 8/1965 Gelbard ..... 416/175
3,450,337 A * 6/1969 Jolette ..... 416/178
3,921,272 A * 11/1975 Klonoski ..... 29/889.4
5,988,979 A * 11/1999 Wang ..... 416/178
6,210,118 B1 * 4/2001 Egawa et al. ..... 416/243
6,942,459 B2 * 9/2005 Li et al. ..... 416/178

* cited by examiner

*Primary Examiner*—Edward K. Look
*Assistant Examiner*—Nathan Wiehe
(74) *Attorney, Agent, or Firm*—Troxell Law Office PLLC

(57) ABSTRACT

The present invention is a radial fan having an axial fan blade configuration. The present invention comprises a hub; a first set of blades around the hub; and a second set of blades on the extending part. Therein, the hub comprises a hollow at the center, an axle, a guiding part and an extending part. The gaps are each between every two adjacent blades of the second blade set, having the same distance between every two adjacent gaps. The second set of blades comprises a plurality of blades around outside of the first set of blade and a ring connected with the blades. Accordingly, the structure of the blades may increase the wind pressure, reduce the energy loss by the blade rotation and raise the work efficiency of the blades while the noise is lessened and the working current is lowered.

5 Claims, 6 Drawing Sheets

RADIAL FAN HAVING AXIAL FAN BLADE CONFIGURATION

FIELD OF THE INVENTION

The present invention relates to a radial fan. More particularly, the present invention relates to a radial fan with a structure of blades that can increase the wind pressure, reduce the energy loss caused by the blade rotation and raise the work efficiency of the blades, while the noise is lessened and the working current is lowered.

DESCRIPTION OF THE PRIOR ART

As is known, a structure of blades according to the prior art as shown in FIG. 5 and FIG. 6 comprises a hub 4 with a connection part 41 around the edge at the bottom; more than one blades 42 extended up from an end surface of the connection part 41; and more than one gaps 43 between blades 42, wherein a structure of blades for a fan is constructed.

Although the above structure of blades for a fan can be installed into a fan to guide an airflow, when the airflow enters from the top surface of the hub 4 and flows to the blades 42, an air turbulence is brought forth by the airflow and the airflow entered can not be guided out smoothly so that energy loss happens and the efficiency gets worse. Not only the amount of the airflow will become lesser because of the occurrences of the air turbulence, but also a great amount of noise will be caused on running. So, the above structure of blades according to the prior art can not fulfill the requirements from the users on actual applications.

BRIEF SUMMARY OF THE INVENTION

Therefore, the main purpose of the present invention is to increase the wind pressure on rotating, to reduce the energy loss caused by the blade rotation and to raise the work efficiency of the blades.

Another purpose of the present invention is to lessen the noise and to lower the working current.

To achieve the above purposes, the present invention is a radial fan having axial fan blade configuration, comprising a hub 1 with a first set of blades and a second set of blades around the outside of the first set of blades. The hub comprises a hollow; a spindle at the center of the hollow; a guiding part along the top edge of the hub; and an extending part along the bottom edge of the hub. The first set of blades is on the side surface of the hub mentioned above, comprising a plurality of blades. And the second set of blades is on the extending part mentioned above and is rounding at the outside of the first set of blades, comprising a plurality of blades, a ring to connect the blades and a plurality of gaps, wherein between every two adjacent blades is a gap having the same distance between every two adjacent ones. Accordingly, when the structure of the blades rotates, the wind pressure is increased, the energy loss caused by the blade rotation is reduced and the work efficiency of the blades is raised, while the noise is lessened and the working current is lowered.

BRIEF DESCRIPTION OF THE DRAWINGS

The present invention will be better understood from the following detailed description of preferred embodiments of the invention, taken in conjunction with the accompanying drawings, in which.

DESCRIPTION OF THE PREFERRED EMBODIMENTS

The following descriptions of the preferred embodiments are provided to understand the features and the structures of the present invention.

Figure 1:
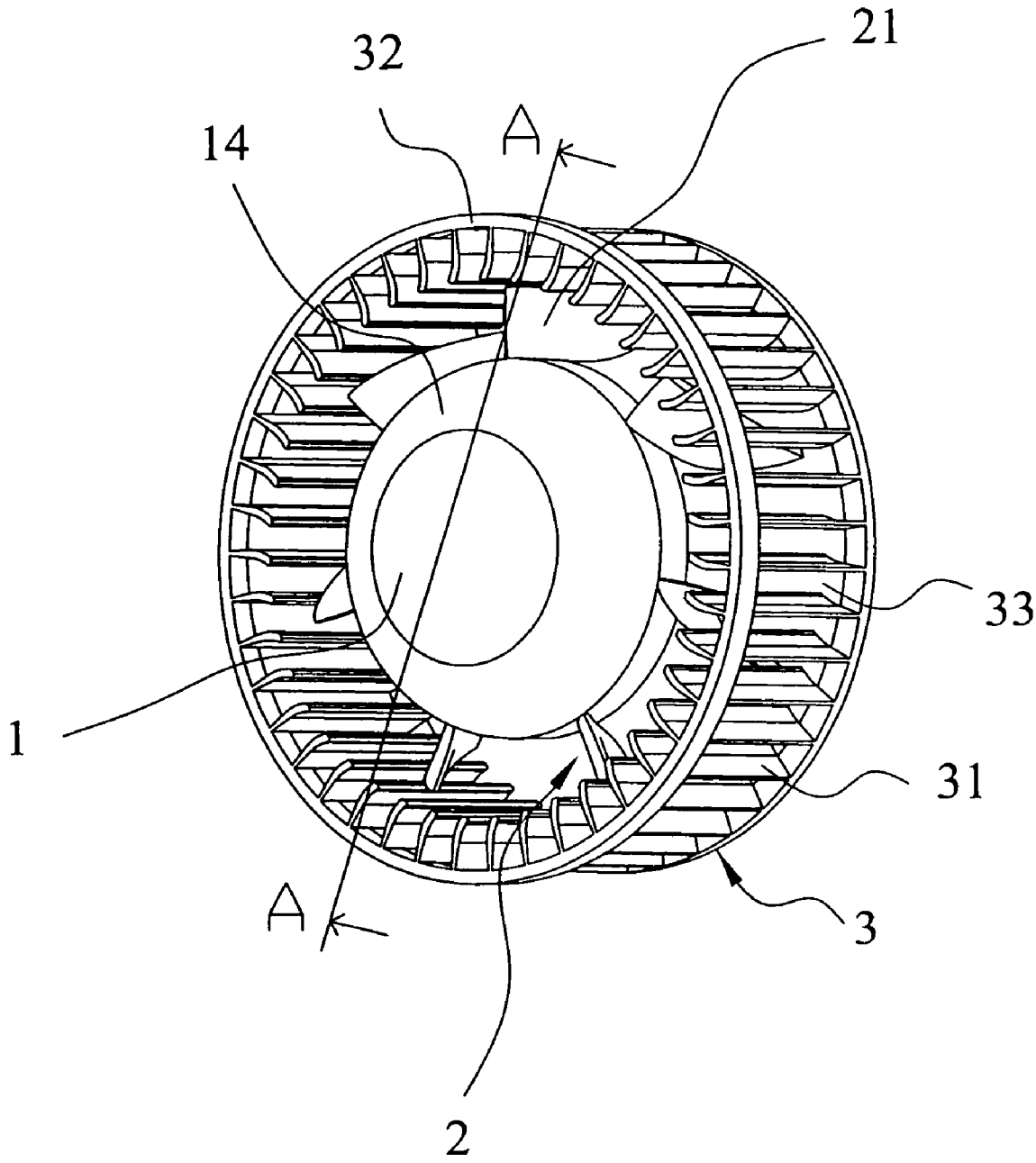
FIG. 1 is a perspective view according to the present invention.
Figure 2:
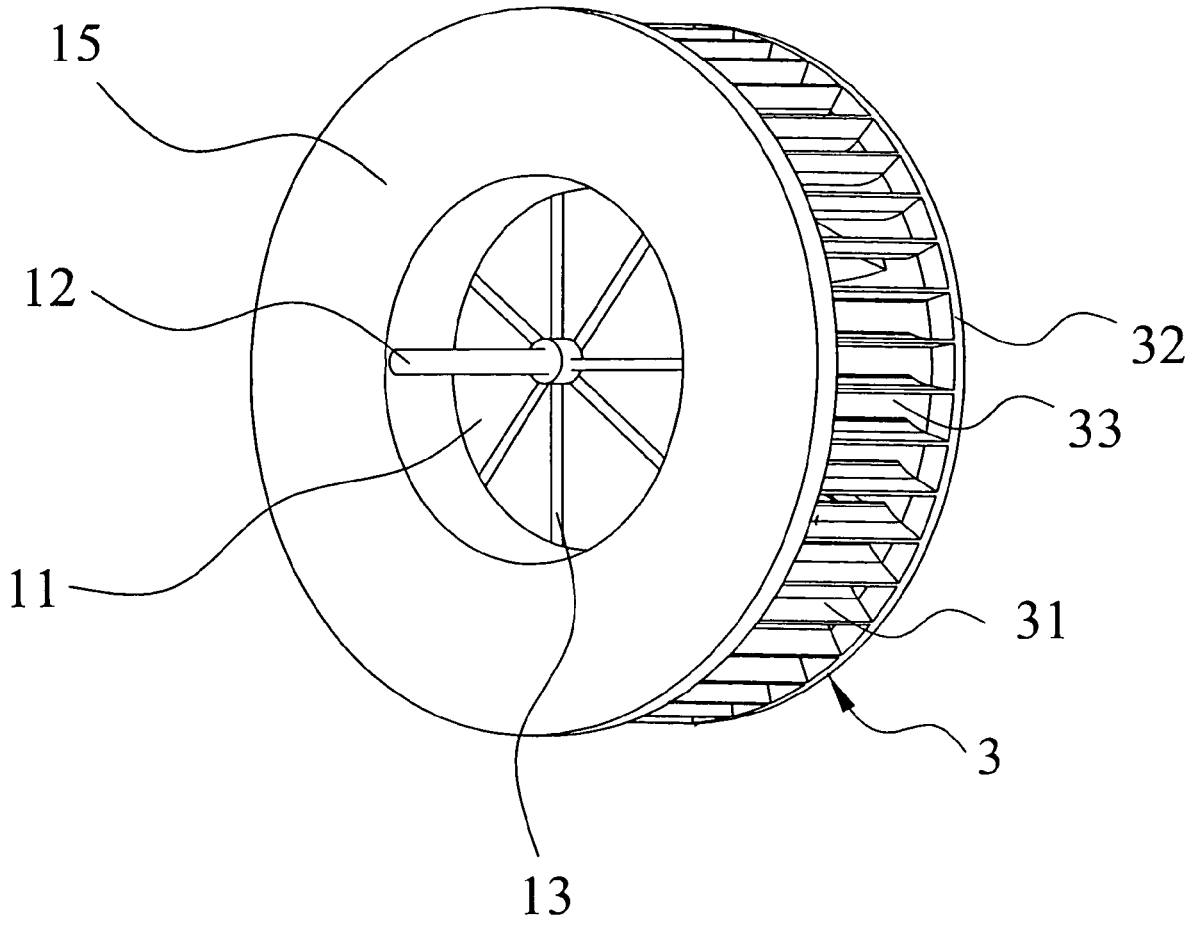
FIG. 2 is another perspective view according to the present invention.

Please refer to FIG. 1 and FIG. 2, which are a perspective view and another perspective view according to the present invention. As shown in the figures, the present invention is a radial fan having axial fan blade configuration, comprising a hub 1, a first set of blades 2 and a second set of blades 3, wherein, when the structure of the blades rotates, the wind pressure is increased, the energy loss by the blade rotation is reduced and the work efficiency of the blades is raised, while the noise is lessened and the working current is lowered.

The hub 1 mentioned above comprises a hollow 11; a spindle 12 at the center of the hollow 11; a plurality of ribs 13 in the hollow 11 near the spindle 12 to strengthen the hub structure; a guiding part 14 of a curved surface along the top edge of the hub 1; and an extending part 15 of a closed curved surface along the bottom edge of the hub 1 with a cambered surface at the connection part with the hub 1.

The first set of blades 2 is on the side surface of the hub 1 mentioned above, and the first set of blades 2 comprises a plurality of blades 21.

The second set of blades 3 is on the extending part 15 mentioned above and is rounded outside of the first set of blades 2, comprising a plurality of blades 31 on the extending part 15 and a ring 32 to connect the blades, wherein a plurality of gaps are each between every two adjacent blades, having the same distance between every two adjacent gaps. By the above structure, a novel radial fan having axial fan blade configuration is constructed.

Figure 3:
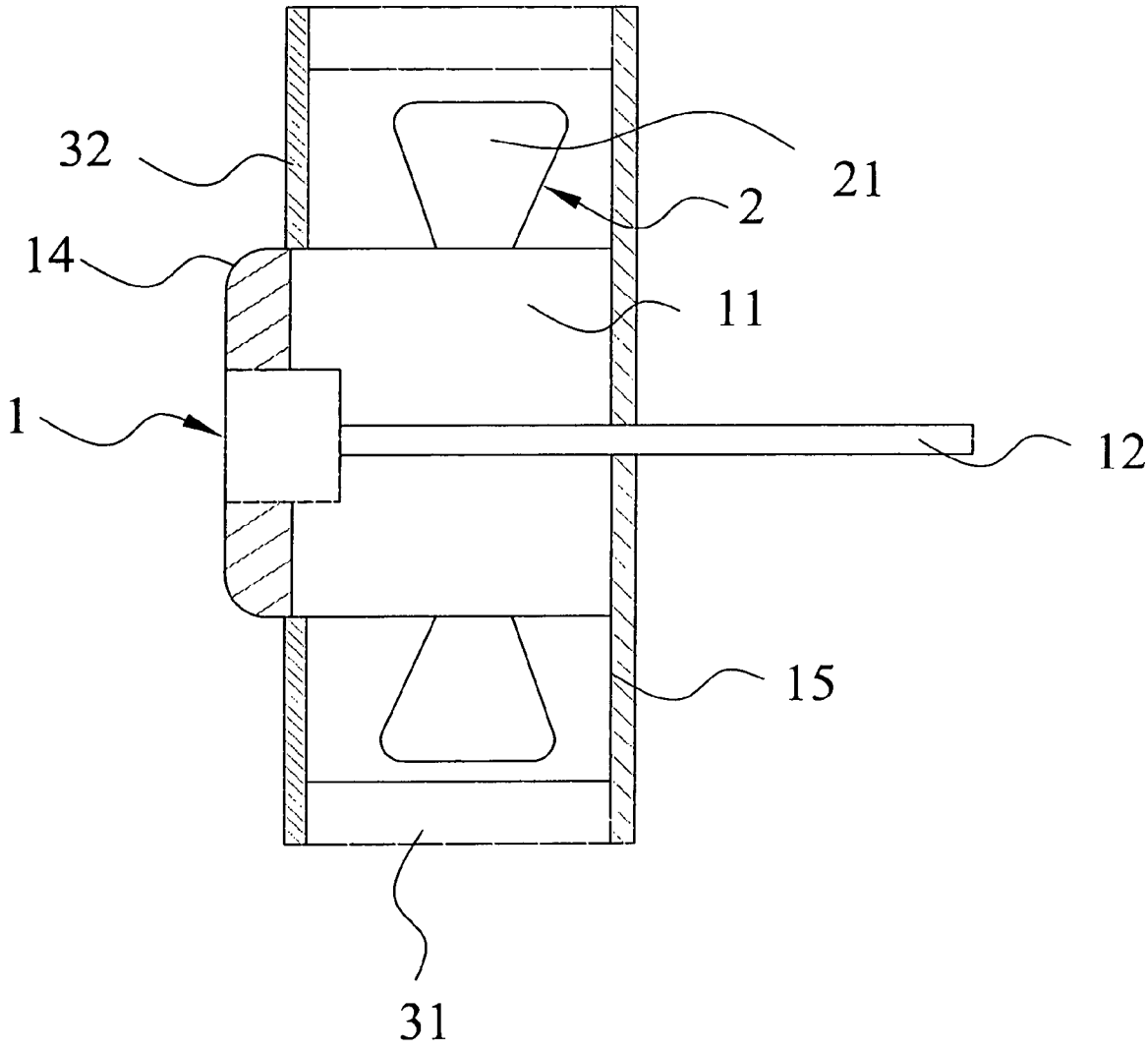
FIG. 3 is a sectional view taken along the line A—A of FIG. 1 according to the present invention.
Figure 4:
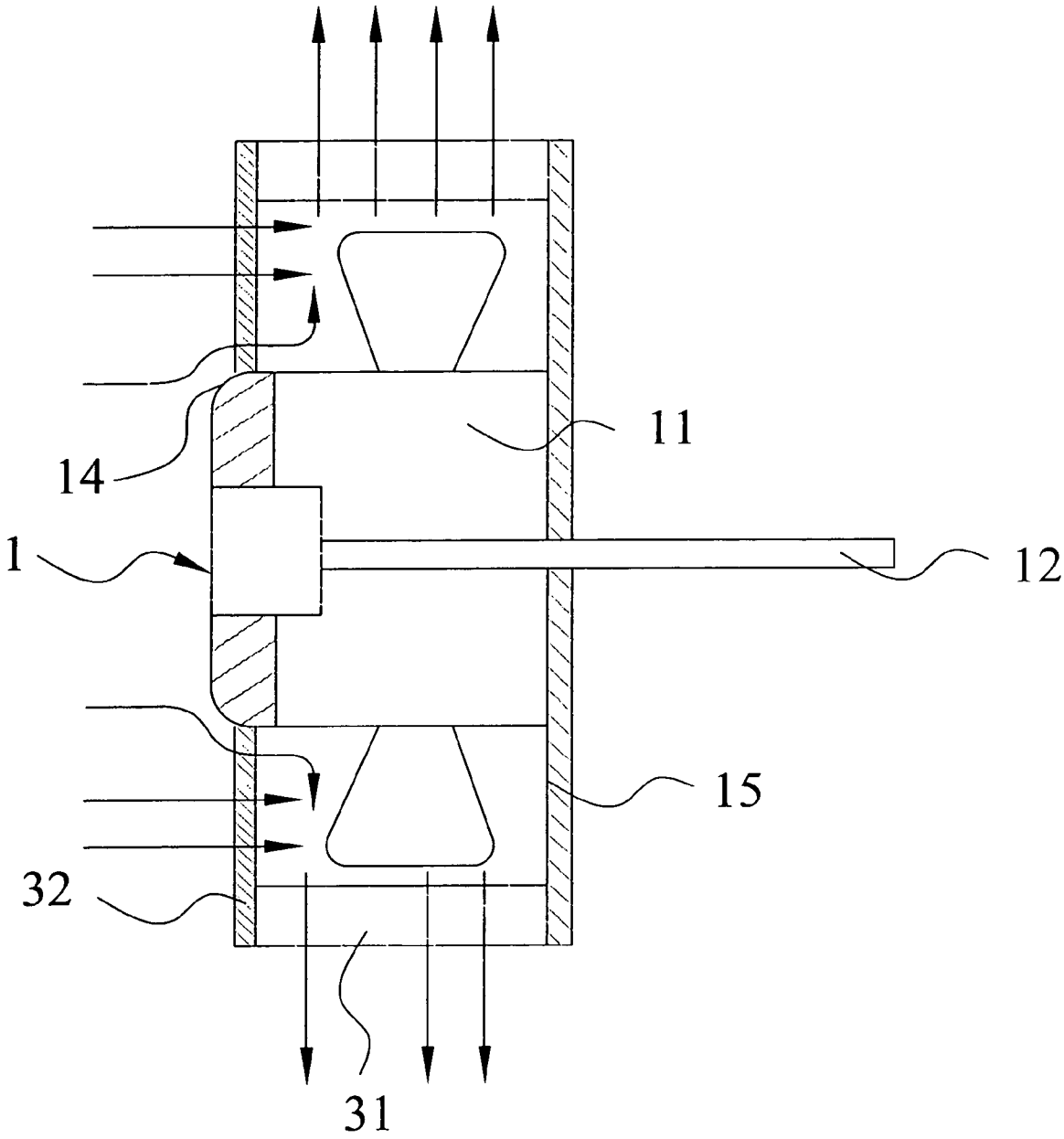
FIG. 4 is a sectional view taken along the line A—A of FIG. 1 for the status of use according to the present invention.
Figure 5:
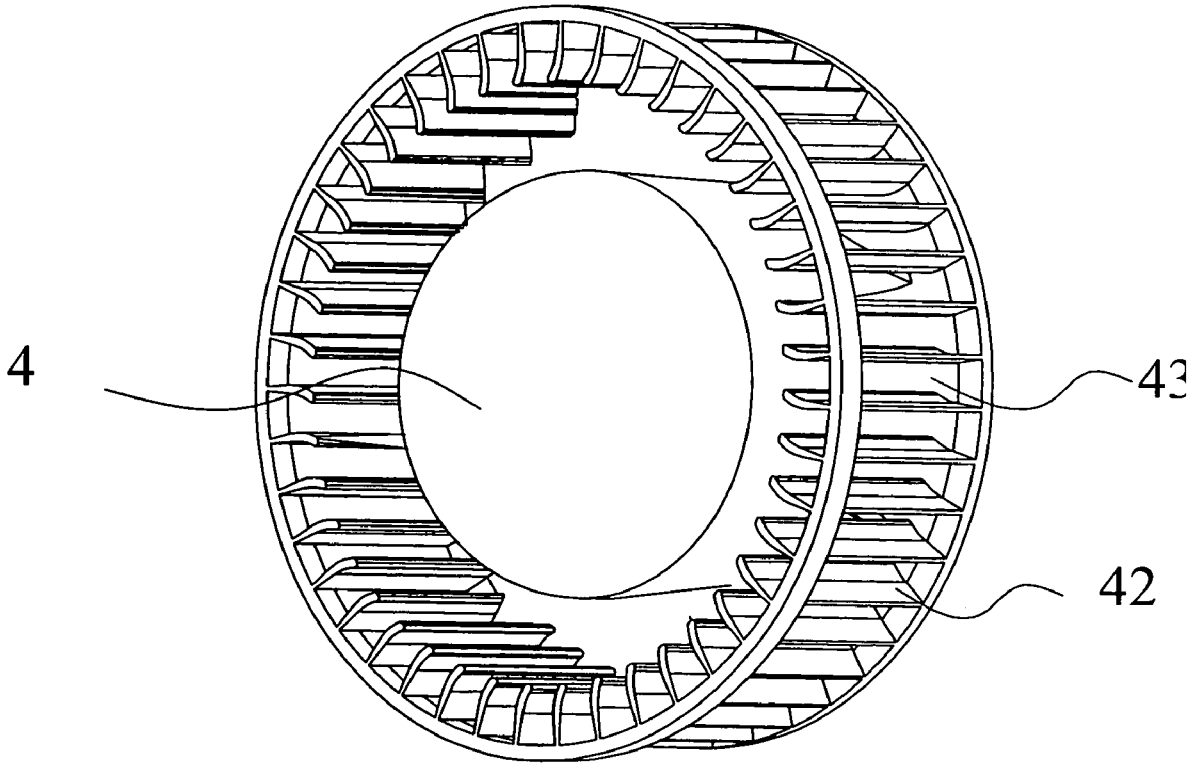
FIG.5 (Prior art)
FIG. 5 is a perspective view according to the prior art.
Figure 6:
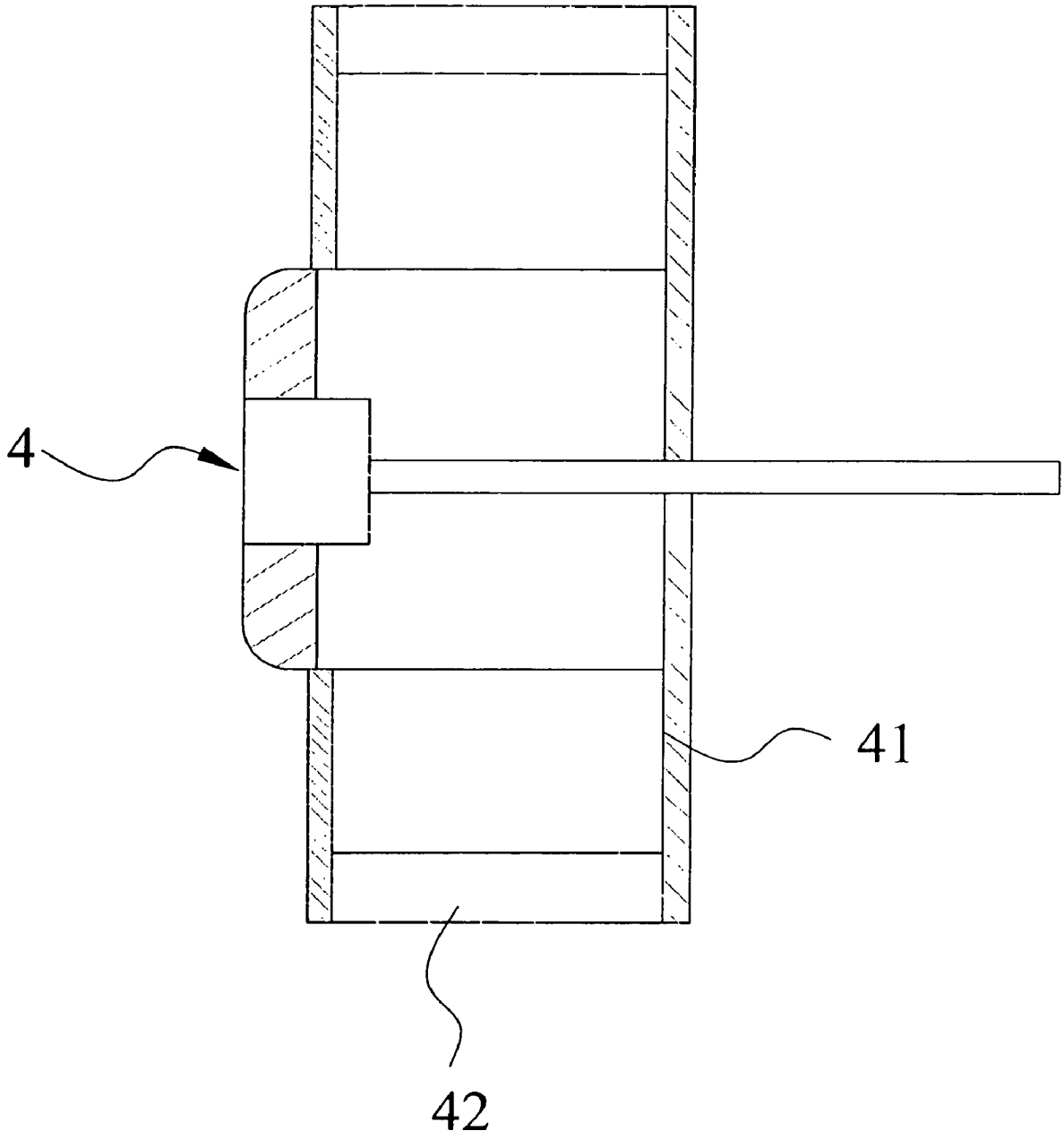
FIG.6 (Prior art)
FIG. 6 is a sectional view according to the prior art.

Please refer to FIG. 3 and FIG. 4, which are a sectional view taken along the line A—A of FIG. 1 and a sectional view taken along the line A—A of FIG. 1 for the status of use, according to the present invention. As shown in the figures, when the blades of the present invention rotate, the airflow enters from the top of the hub 1. At first, the airflow entered is guided by the guiding part 14 with a fillet radius of at least 3 millimeter along the top edge of the hub 1 to flow to the bottom of the hub 1. As the airflow is guided to the bottom of the hub 1, by setting the first set of blades, the air pressure of the airflow is increased by a plurality of blades 21 of the first set of blades 2, so that the airflow is guided to the second set of blades 3 by the extending part 15 of a closed curved surface along the bottom edge of the hub 1 with a cambered surface at the connection part with the hub 1. At the time when the airflow flows through the extending part 15 to the second set of blades 3, the airflow is guided to blow out of the gaps 33 by a plurality of blades between the extending part 15 and the ring 32. By doing so, while the noise is lessened and the working current is lowered, the structure of the blades may increase the wind pressure on rotating, reduce the energy loss caused by the blade rotation and raise the work efficiency of the blades.

The preferred embodiments herein disclosed are not intended to unnecessarily limit the scope of the invention. Therefore, simple modifications or variations belonging to the equivalent of the scope of the claims and the instructions disclosed herein for a patent are all within the scope of the present invention.

What is claimed is:

1. A radial fan having an axial fan blade configuration, comprising:

a substantially cylindrical hub which comprises a hollow with a spindle at a center of said hollow, a curved guiding part located along the edge of a first end surface of said hub, and an extending part directly connected to an edge of a second end surface of said hub;

a first set of blades having a plurality of first blades extending outwardly from a side surface of said hub; and a second set of blades having a plurality of second blades located on said extending part, wherein said second set of blades is located around an outside of said first set of blades and said second set of blades includes a ring connected to said plurality of second blades; and wherein each of the plurality of second blades is spaced apart an equal distance from an adjacent second blade of the plurality of second blades forming an equally spaced gap there between, wherein said plurality of first blades are spaced apart from said extending part, said ring, and said plurality of second blades.

2. The radial fan according to claim 1, wherein said hollow includes ribs near said spindle.

3. The radial fan according to claim 1, wherein the fillet radius of said guiding part is at least 3 millimeter.

4. The radial fan according to claim 1, wherein said extending part comprises a closed surface joined with said hub to form a continuous partition between said hollow and said first and said second sets of blades.

5. The radial fan according to claim 4, wherein said hollow is substantially cylindrical.

* * * * *